United States Patent [19]

Narancic et al.

[11] Patent Number: 4,855,705

[45] Date of Patent: Aug. 8, 1989

[54] FUSE WITH A SOLID ARC-QUENCHING BODY MADE OF NON-POROUS RIGID CERAMIC

[75] Inventors: Vojislav Narancic, Ville d'Anjou; Gilles Fecteau, Boucherville, both of Canada

[73] Assignee: Hydro-Quebec, Montreal, Canada

[21] Appl. No.: 270,478

[22] Filed: Nov. 9, 1988

Related U.S. Application Data

[63] Continuation of Ser. No. 46,535, May 6, 1987, abandoned.

[30] Foreign Application Priority Data

Mar. 20, 1987 [CA] Canada ..... 532649

[51] Int. Cl.[4] ..... H01H 85/14

[52] U.S. Cl. ..... 337/246; 337/158; 337/282

[58] Field of Search ..... 337/246, 247, 248, 250, 337/252, 263, 228, 280, 282, 158

[56] References Cited

U.S. PATENT DOCUMENTS

| | | | |
|---|---|---|---|
| 3,838,375 | 9/1974 | Frind et al. | 337/276 |
| 4,003,129 | 1/1977 | Koch et al. | 29/623 |
| 4,159,458 | 6/1979 | Wiebe | 337/232 |
| 4,320,374 | 3/1982 | Narancic et al. | 337/162 |
| 4,374,371 | 2/1983 | Narancic | 337/159 |
| 4,479,299 | 10/1984 | Fecteau | 29/623 |
| 4,540,969 | 9/1985 | Sugar | 337/248 |

*Primary Examiner*—H. Broome

*Attorney, Agent, or Firm*—Foley & Lardner, Schwartz, Jeffery, Schwaab, Mack, Blumenthal & Evans

[57] ABSTRACT

A high power current-limiting fuse comprises a cylindrical envelope which closely surrounds a metallic fusible element in the form of a wire or ribbon. The cylindrical envelope is made of high density rigid ceramic such as Alumina of formula $Al_2O_3$, and Beryllium oxide of formula BeO. The two ends of the envelope are metallized to form two terminals respectively connected to the ends of the fusible element, whereby the current-limiting fuse is connectable to an electric circuit to be protected through the two so formed terminals. A sheath of fiberglass or ceramic can be mounted around the cylindrical envelope so as to increase the mechanical rigidity of the current-limiting fuse.

23 Claims, 6 Drawing Sheets

FUSE WITH A SOLID ARC-QUENCHING BODY MADE OF NON-POROUS RIGID CERAMIC

This application is a continuation, of application Ser. No. 046,535, filed May 6, 1987.

BACKGROUND OF THE INVENTION

1. Field of the invention:

The present invention relates to a current-limiting fuse comprising an electrically conducting fusible element closely surrounded by a solid envelope made of non porous rigid material, in particular of high density ceramic. The invention also relates to a method of manufacturing such a fuse.

2. Brief description of the prior art:

Generally speaking, a fuse is an electric device designed to conduct a current and to interrupt this current when it reaches a predetermined value, in order to protect an electric circuit against a too high current. The very high fault currents are therefore interrupted well before their maximum amplitude is reached. Consequently, a fuse limits the energy developed in a faulty electric circuit so as to prevent damages thereto.

The conventional high power current-limiting fuses usually comprise an electrically insulating tube made of fiberglass or of ceramic and closed at each end by metallic closures. Such closures constitute terminals for the connection of the fuse in an electric circuit to be protected. Such conventional fuses also enclose at least one electrically conducting fusible element in the form of a wire or ribbon and having its two ends respectively connected to the two metallic closures. The fusible elements are made of metals such as silver, copper, aluminum, and so on, and are surrounded b an arc constricting agent, usually consisting of packed quartz sand which fills the insulating tube.

When a fault current flows through the fusible element, the metal of the same heats and reaches its melting point at locations determined by its geometry. A current interrupting electric arc is then produced, whose resistance increases up to a value sufficient to develop an arc voltage higher than the voltage of the source. As this arc voltage has a polarity opposite to that of the source voltage, it forces the fault current to a zero value. The characteristics of the fault current decrease are closely related to the nature of the arc constricting agent.

As the quartz sand has a low thermal conductivity and only partly fills (about 70%) the inner volume of the insulating tube, a low dissipation of the heat produced by the electric arc results, and accordingly the time required by the fuse to interrupt the current and the energy developed in the fuse both increase. Upon arcing, the metal of the fusible element is vaporized and an internal pressure is created. The so created pressure displaces the particles of the quartz sand to form a void having dimensions greater than the initial ones of the fusible element. A slow rise in arc voltage then results, while the time required for interrupting the current increases.

In order to increase the thermal conductivity and the mechanical rigidity of the quartz sand, U.S. Pat. Nos. 3,838,375 (FRIND et AL) issued on Sept. 24, 1974, and 4,003,129 (KOCH et AL) issued on Jan. 18, 1977, disclose binding of the quartz sand by means of an inorganic binder. The binder is so selected that the porosity of the arc constricting agent is not affected. Improved performance is obtained with fuses using as arc constricting agent bound quartz sand in comparison with the conventional fuses using classically packed sand.

OBJECT OF THE INVENTION

An object of the present invention is to still improve the performance of current limiting fuses, in particular high power current-limiting fuses by replacing the quartz said with or without inorganic binder by a solid envelope made of a nonporous rigid material, in particular of high density ceramic. The nonporous rigid material closely surrounds the fusible element and presents a high dielectric resistivity at the high temperature of the electric arc and a high resistance to shocks of pressure and high temperature caused by the arc.

SUMMARY OF THE INVENTION

More specifically, according to the present invention, there is provided a current-limiting fuse comprising (a) a fusible element designed to conduct an electric current and to melt and thereby interrupt this current when it reaches a predetermined value, (b) solid arc quenching envelope made of non porous rigid material closely surrounding the fusible element, and (c) a pair of terminals mounted on the envelope, interconnected together through the fusible element, and providing for connection of the fusible element in an electric circuit to be protected against an overcurrent. As already mentioned, the non-porous rigid material of the envelope has a high dielectric resistivity at the high temperature of an electric arc produced within the envelope upon melting of the fusible element, as well as a high resistance to shocks of pressure and high temperature caused by the electric arc.

Preferably, the rigid material of the envelope is a ceramic such as Alumina of formula $A1_2O_3$, and Beryllium oxide of formula BeO. Such ceramics further present a high thermal conductivity and a high specific heat to rapidly absorb the heat produced within the envelope by the electric arc.

As will be explained in greater detail hereinafter, the ceramics having a high mechanical resistance as well as a high resistance to the high temperature of the electric arc cause a faster rise in arc voltage in comparison with the prior art fuses, and accordingly a very fast interruption of the fault current.

According to the present invention, there is also provided a method of manufacturing a current-limiting fuse, comprising the steps of (a) producing a fusible element designed to conduct an electric current and to melt and thereby interrupt this current when the same reaches a given value, (b) producing a solid envelope made of non-porous rigid material and defining a cavity of same shape and dimensions as the fusible element, (c) inserting the fusible element in the cavity defined in the envelope so that the non-porous rigid material closely surrounds the fusible element, and (d) mounting on the envelope a pair of terminals interconnected together through the fusible element, which pair of terminals provides for connection of the fusible element in an electric circuit to be protected against an overcurrent. Again, the non-porous rigid material of the envelope has a high dielectric resistivity at the high temperature of an electric arc produced within the envelope upon melting of the fusible element, as well as a high resistance to shocks of pressure and high temperature caused by the electric arc.

Preferably, the step of mounting the pair of terminals on the envelope comprises the step of metalizing this envelope at the two ends thereof.

In accordance with a preferred embodiment of the invention, the fusible element is elongated, the step of producing the envelope comprises the production of two complementary pieces made of the non-porous rigid material and each having a surface of contact with the other of these two complementary pieces, the contact surface of one of the two complementary pieces comprising a groove having the same shape and dimensions as the fusible element, and the fusible element inserting step consists in inserting the fusible element in the groove and in assembling the two complementary pieces by joining their contact surfaces.

According to another aspect of the preset invention, there is provided a method of manufacturing a current-limiting fuse comprising the step of producing a solid envelope made of non-porous rigid material and defining a cavity, which material has a high dielectric resistivity at high temperatures as well as a high resistance to shocks of internal pressure and high temperature. This method of manufacturing a current-limiting fuse further comprises a step of injecting a molten metal within the cavity of the envelope to form a fusible element designed to conduct an electric current and to melt and thereby interrupt this electric current when the same reaches a given value, and a step of mounting on the envelope a pair of terminals interconnected together through the fusible element. The pair of terminals provides for connection of the fusible element in an electric circuit to protected against an overcurrent.

According to a preferred embodiment of the latter method of manufacturing a current-limiting fuse, the step of producing the envelope comprises the use of pieces of metal having a high melting point to form the cavity in the envelope.

A sheath of fiberglass or of ceramic may surround the envelope of the fuse according to the invention in order to increase the rigidity of the resulting fuse.

The objects, advantages and other features of the present invention will become more apparent upon reading of the following non-restrictive description of preferred embodiments thereof, given for the purpose of exemplification only with reference to the accompanying drawings in which:

DETAILED DESCRIPTION OF THE PREFERRED EMBODIMENTS

Figure 1:
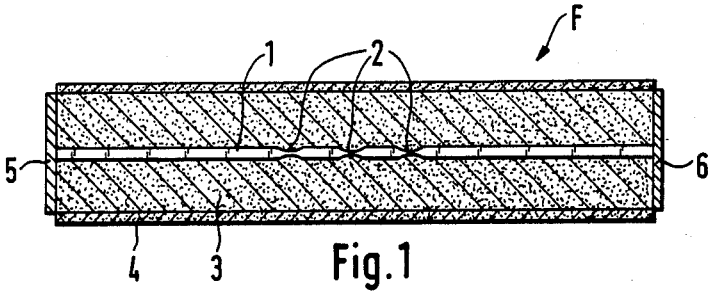
FIG. 1 represents a longitudinal cross section of a fuse according to the invention, comprising an envelope made of high density rigid ceramic closely surrounding the fusible element.

The high power current-limiting fuse F of the present invention, as illustrated in longitudinal cross section in FIG. 1 of the attached drawings, comprises a metallic fusible element 1 in the form of a ribbon. The fusible element 1 comprises at least one width constriction 2 (three such width constrictions being illustrated, for example, in FIG. 1) where an electric arc is produced upon fusion of the fusible element at this point. Of course, the width constricted regions 2 of the element 1 are first susceptible to fusion. Indeed, due to their cross section of reduced area, they heat more rapidly when subjected to an electric current.

The number of width constrictions of the ribbon forming the element 1, where electric arcs are produced upon fusion of the constricted regions of the fusible element, can be varied at will and selected with a conventional method in accordance with the requirements of a given application. It is also well known to replace the width constrictions 2 shown in FIG. 1 by perforations bored through the metallic ribbon constituting the element 1.

The following explanations are related to a single current interrupting arc. However, it can be appreciated that these explanations relate to each electric arc when the fusible element in the form of a ribbon comprises a plurality of width constrictions or a plurality of perforations.

The fusible element 1 is closely surrounded by an envelope 3 made of high density (non porous) rigid ceramic. Although high density rigid ceramics, such as Alumina of formula $Al_2O_3$,and Beryllium oxide of formula BeO are particularly suitable for use in the manufacture of the envelope 3, other ceramics even not classified as high density can be used provided they are non-porous and they present the following characteristics:

(a) a very high resistance to shocks of internal pressure;

(b) a very high resistance to shocks of high temperature;

(c) a high dielectric resistivity at high temperatures; and (d) a high thermal conductivity and a high specific heat.

The ceramic envelope 3 must have sufficient dimension to support the shocks of internal pressure and high temperature caused by the production of the electric arc upon the interruption of current without either cracking or exploding, to thereby form a highly impervious enclosure. The envelope 3 can alternatively be of reduced dimensions, but reinforced by a cylindrical sheath 4 made of fiberglass or of less expensive ceramic.

The two ends of the envelope 3 of the fuse F are metalized as indicated by the reference numerals 5 and 6. Such metalization is carried out in accordance with the conventional methods, directly on the ceramic. The two so obtained electric terminals 5 and 6 provide for connection of the fuse F, more specifically of its fusible element 1, in an electric circuit to be protected against an eventual overcurrent. Of course, during metalization of the ceramic, the metal contacts with the two ends of the fusible element 1 to thereby connect it between the terminals 5 and 6.

Figure 2A:
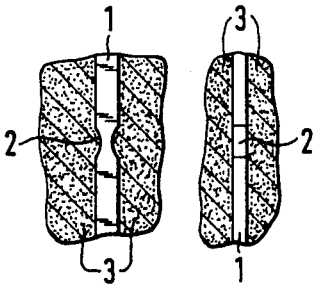
FIG. 2*a* represents the physical condition of the fuse of FIG. 1, before fusion of the fusible element.

FIG. 2*a* illustrates the physical condition of the fuse F before fusion of the fusible element 1, i.e. during conduction of current. At this moment, the fusible element 1 is closely surrounded by the ceramic envelope 3.

Upon fusion of the fusible element 1, the very high temperature of the electric, current interrupting arc vaporizes very rapidly the element 1 and creates a pressure at the point of production of the arc (i.e. at the width constriction of the metallic ribbon), which pressure must be maintained by the high imperviousness of the ceramic envelope 3. The so created pressure causes a very fast rise of the arc voltage, and when the same reaches a value higher than that of the source voltage, a current opposite to the fault current is generated, which opposite current forces very rapidly the fault current to zero. The metallic vapors condense on the walls of the ceramic in the form of small drops, whereby the terminals 5 and 6 of the fuse F, and more specifically the terminals created by the ends of the fusible element 1 on each side of its molten and vaporized portion, are efficiently, electrically insulated.

Alumina of formula $Al_2O_3$, and Beryllium oxide of formula BeO are ceramics which are particularly suitable for the manufacture of a fuse F according to the invention. Indeed, these ceramics can maintain the pressure created by the electric arc during a time period shorter than 200 microseconds, that is during a time period sufficient to allow the arc voltage to reach its peak value. During the following few milliseconds, the surfaces of these ceramics in contact with the electric arc are subjected to high temperature and pressure, whereby a small portion thereof reaches its melting point. A cavity having dimensions somewhat greater than that of the fusible element is thereby formed by the combined effect of pressure and temperature. The creation of this cavity facilitates decomposition of the produced gas and increases the dielectric distance between the terminals of the fuse created by the fusion of the element 1. The condensation of the metallic vapors on the ceramic walls of the cavity produces, as already mentioned, a plurality of small metal drops separated from each other by a distance which provides an excellent dielectric resistance when the arc is extinguished. The high dielectric resistivity of these ceramics at the high temperature of the arc also contributes to the fast dielectric reinstatement of the fuse F. Moreover, due to their high thermal conductivity and high specific heat, these ceramics absorb rapidly the heat produced by the electric arc to thereby reduce the internal temperature of the fuse and contribute to the reduction of the time of interruption of the current.

Figure 2B:
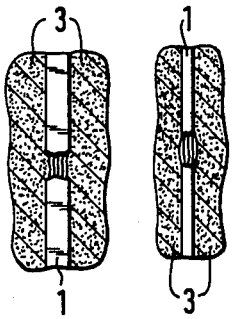
FIG. 2*b* represents the physical condition of the fuse of FIG. 1, after fusion of the fusible element.

FIG. 2*b* shows the physical condition of the fuse F after fusion of the element 1. The cavity formed at the location of the molten portion of the element 1 is of relatively low volume, whereby the pressure has been maintained at the point of fusion of the element 1.

Figure 3:
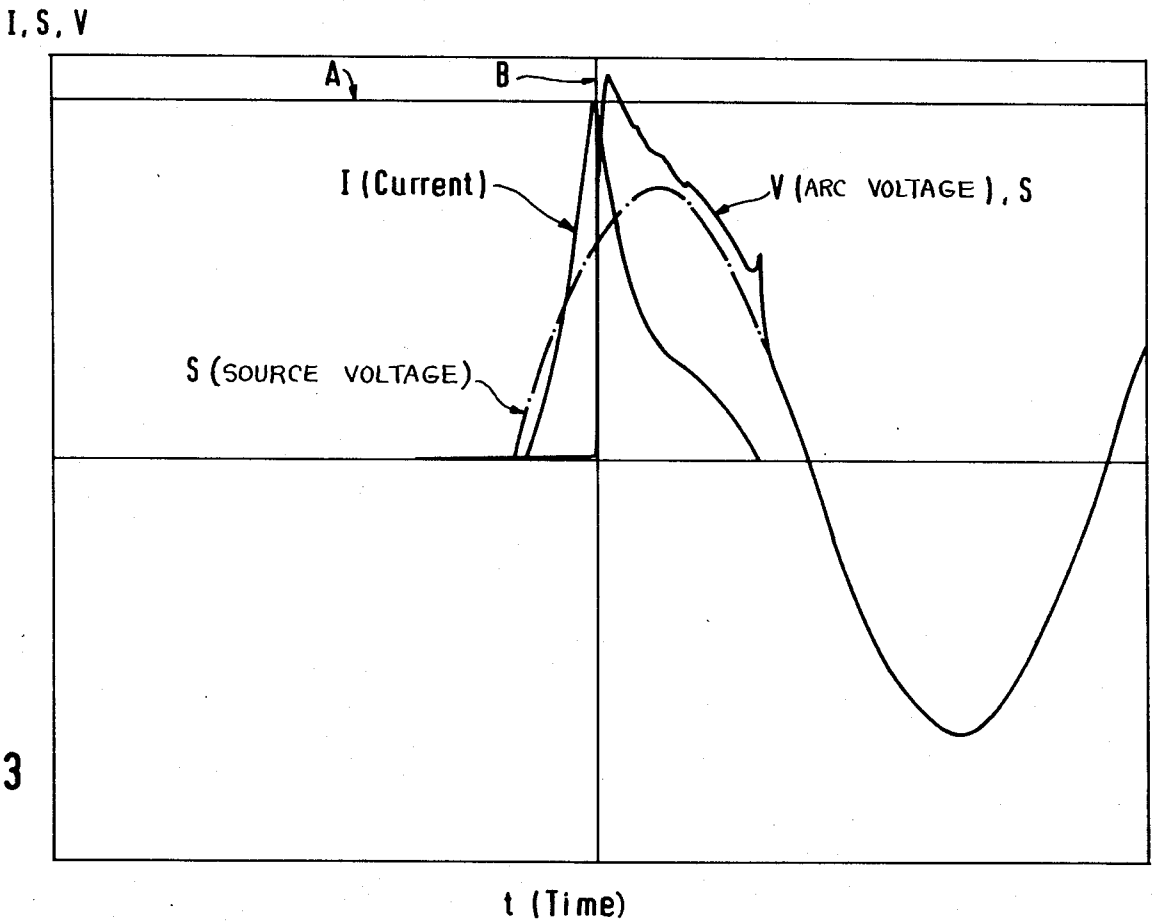
FIG. 3 presents a typical oscillogram illustrating the operation of the fuse according to the invention during a current interruption.

FIG. 3 represents a typical oscillogram illustrating the operation of a fuse F according to the invention. This oscillogram shows the very fast rise of the arc voltage V following the fusion of the fusible element 1, which fusion occurs at an instant indicated by the line B in FIG. 3. The oscillogram further shows the very fast interruption of the fault current I, having a maximum value represented by the line A. As can be seen on FIG. 3, the rise of the current I is interrupted when the amplitude of the arc voltage V reaches that of the source voltage S. The oscillogram therefore demonstrates that the ability of the high density rigid ceramic to support shocks of pressure and high temperature, which allows the envelope 3 to maintain the pressure at the point of production of the arc upon interruption of the current, enables a very fast rise of the arc voltage V compared with the fuses of the prior art, which results in high efficiency of interruption of the fault current I, and, as it will be explained in more detail hereinafter, in a substantial reduction of the integral $I^2t$ ( the integral of the square of the current I over a given time interval)of the fuse F.

As also illustrated in FIG. 3, the difference between the maximum value of the current indicated by the line A and that of the interrupted current at the instant of striking of the arc represented by the line B is lower than 1%. When the increase in fault current is interrupted and the slope of the curve representing the fault current I becomes negative, the increase in arc voltage V is also interrupted. Consequently, in the case of the fuse F according to the invention, the amplitude of the fault current I is limited very rapidly by the fast rise in arc voltage V, and that without excessive increase in the peak value of the developed arc voltage V. Experimentations have demonstrated that this peak value of the developed arc voltage is greatly reduced in comparison with fast current-limiting fuses of the prior art using quartz sand including or not an inorganic binder.

Figure 4:
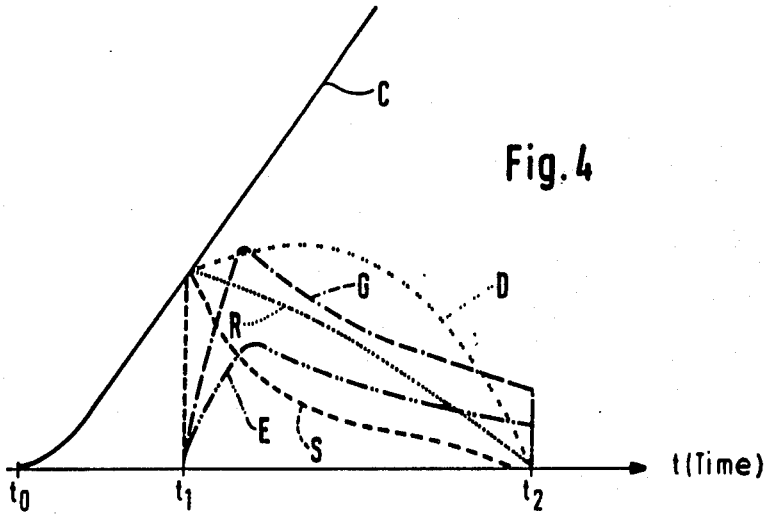
FIGS. 4, 5*a* and 5*b* are graphs which demonstrate the advantages of the fuse according to the present invention with respect to those of the prior art.

FIG. 4 is a series of curves comparing the operation of the fuse according to the invention with respect to the operation of prior art fuses using as arc constricting agent quartz sand including or not a binder. It should be noted that the different fuses comprise similar fusible elements.

In FIG. 4, curve C illustrates the slope of a presumed fault current, applied to the different fuses at instant $t_o$. More specifically, curve C represents a short circuit current and its evolution in function of time when it is not interrupted. The fusible element of each fuse melts at a same instant $t_1$.

Curve D of FIG. 4 is the evolution with respect to time of the current in a conventional fuse using as arc constricting agent packed quartz sand without binder. Curve D demonstrates that in such fuses, the fault current propressively increases after fusion of the fusible element, and thereafter slowly reduces to reach a zero value at the instant $t_2$. This phenomenon is caused by the slow rise in arc voltage in such a fuse and also to the relatively low peak amplitude of this arc voltage, as illustrated by the curve E in FIG. 4.

Curve R is the evolution of the fault current with respect to time in a fuse as described in U.S. Pat. No. 3.838.375 (FRIND et AL). The curve R clearly demonstrates that a better protection against overcurrents is obtained with a fuse using as arc constricting agent quartz sand including an inorganic binder, in comparison with a fuse using quartz sand without binder. As the energy transmitted to the protected circuit corresponds to the integral $I^2t$ for the time interval between the instants $t_o$ and $t_2$, it can be easily appreciated that the fuse of U.S. Pat. No. 3.838.375 (FRIND et AL) considerably reduces the quantity of energy transmitted to the protected circuit, in comparison with the prior art fuses using as arc constricting agent quartz sand without binder. This is caused by the well faster rise in arc voltage and the higher arc voltage peak value obtained with the fuse according to U.S. Pat. No. 3.838.375 (see curve G in FIG. 4). An immediate and progressive reduction in current through the fusible element results, and that until the current reaches a zero value at time $t_2$.

The evolution of the fault current with respect to time in a fuse according to the invention is shown by the curve S of FIG. 4. The curve S clearly demonstrates the fundamental superiority of the fuse F according to the invention. This improvement is obtained through the use of a high density rigid ceramic envelope, for the different reasons discussed in detail hereinabove, and that without excessive increase in peak amplitude of the arc voltage V (see FIG. 3). The significant reduction in the integral $I^2t$ and the low increase in arc voltage peak amplitude constitute evident advantages of the fuse F.

Figure 5A:
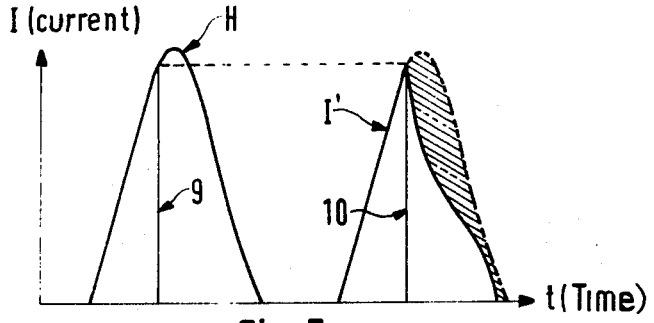
Figure 5B:
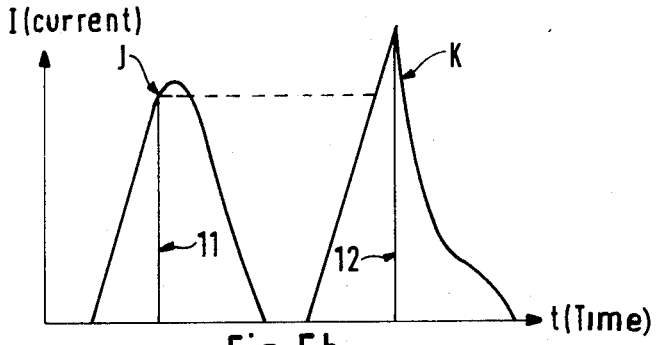

In FIGS. 5*a* and 5*b*, two different fuses are compared, one using as arc constricting agent quartz sand without binder (left curve) and the other using a high density rigid ceramic envelope in accordance with the present invention (right curve).

In FIG. 5*a* of the drawings, curves H and I' respectively represent the evolution of the current in a fuse using quartz sand without binder, and in a fuse according to the invention. The two fuses have similar fusible elements and the vertical lines 9 and 10 respectively indicate the instant of fusion of the fusible element for the two different fuses. The shaded area of the curve I' shows the reduction in the integral $I^2t$ in the fuse F according to the invention.

When it is not important to obtain a reduction in the integral $I^2t$, the mass of the metallic fusible element 1 can be increased in order to delay its fusion. In this manner, the maximum amplitude of the interrupted current as well as the integral $I^2t$ are both increased. In FIG. 5*b*, the evolution of the current in function of time within the two types of fuses is presented, namely in the fuse according to the invention (curve K) and in a classical fuse using as arc constricting agent quartz sand without binder (curve J). The mass of the fusible element 1 of the fuse F according to the invention (curve K) has been increased with respect to that of the fusible element of the conventional fuse (curve J) so that the two fuses have total integrals $I^2t$ which are identical. The fuse according to the invention (curve K) however presents a prearc integral $I^2t$ which is two or three times greater than that of the conventional fuse (curve J). This constitutes an important advantage because no increase in the total integral $I^2t$ results. It should be noted that in FIG. 5*b*, the vertical lines 11 and 12 respectively indicate the instant of fusion of the fusible elements of the conventional fuse and of the fuse according to the invention.

As mentioned hereinabove, a desired total integral $I^2t$ can be obtained by appropriately determining the mass of the fusible element. In determining such a mass, the high thermal conductivity and the high specific heat of the high density rigid ceramic should be taken into consideration. Indeed, as the fusible element 1 is in contact with the ceramic, the latter reduces the temperature of the fusible element 1 during steady-state conduction of current. The fusion of the element 1 caused by a fault current is also delayed by the important mass of ceramic of the envelope 3 which absorbs and dissipates heat.

In order to carry out some applications, it is desirable to increase the prearc integral $I^2t$ while maintaining a low postarc integral $I^2t$ (FIG. 5*b*). Such a characteristic of operation can be obtained with the fuse F according to the invention and therefore constitutes an important advantage thereof. In particular, such an increase in the prearc integral $I^2t$ allows the fuse F to protect motor and transformer circuits without untimely operation of the fuse upon switching on of these circuits.

The fuse F according to the invention presents another interesting property, namely the ability to protect direct current circuits. Indeed, experimentations have confirmed that the efficiency of the fuse F in interrupting a direct current is higher than that of the prior art fuses. Use of the fuse according to the invention to protect high power capacitor batteries is therefore possible. As the fuse F according to the invention presents a low integral $I^2t$ and a low arc overvoltage, another of its applications is the protection of semiconductor circuits.

A further advantage of the fuse F according to the invention is its high resistance to mechanical shocks. It is well known that the resistance to mechanical shocks of the classical high power fuses depends on the density of compaction of the quartz sand or other particulate material without binder which surrounds the fusible element. Repeated mechanical shocks can effectively damage the fusible element(s), in particular the fusible element(s) of the classical fuses of small diameter. In the fuse F according to the invention, the different elements form a rigid and compact mass. Consequently, breaking of the thin fusible elements is prevented.

The manufacture of envelopes made of high density ceramic such as Alumina of formula $Al_2O_3$, and Beryllium oxide of formula BeO, requires high pressure and temperature, i.e. a temperature higher than 1100° C. Therefore, the metallic fusible element 1 cannot be inserted in the ceramic during the manufacture of the envelope as its melting point corresponds to a relatively low temperature.

To meet with this requirement, pieces of ceramic are previously formed with a cavity designed to receive a separately produced fusible element 1. After insertion of the fusible element 1 within the cavity, the different ceramic pieces are cemented together and the so cemented pieces are kilned at a reduced temperature to form the envelope 3.

Figure 6:
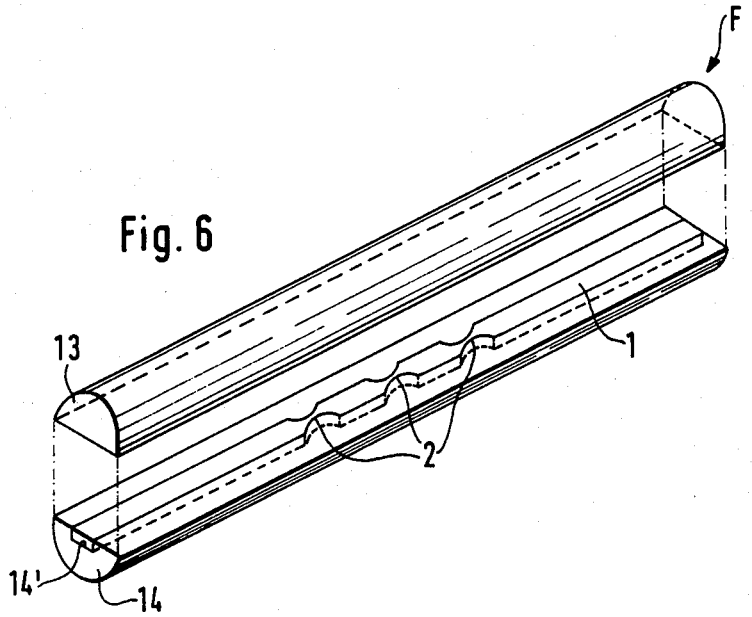
FIG. 6 illustrates a first method of manufacturing the ceramic envelope of the fuse according to the invention.

A first method of manufacturing the envelope 3 is illustrated in FIG. 6 of the drawings. In a first step, two elongated complementary pieces 13 and 14 made of high density rigid ceramic and having a cross section in the form of a half-moon are produced. A longitudinal groove 14' is formed in the planar surface of the piece 14, this groove having the same shape and dimensions as the fusible element 1. After the element 1 has been inserted in the groove 14', the planar surfaces of the pieces 13 and 14 are joined together by means of an inorganic ceramic cement. The two planar surfaces of the so joined pieces 13 and 14 are then pressed against each other by means of a mechanical pressure, and the so pressed pieces 13 and 14 are baked in a kiln at a temperature lower than the melting point of the metallic element 1. A rigid and impervious cylindrical envelope results.

Figure 7:
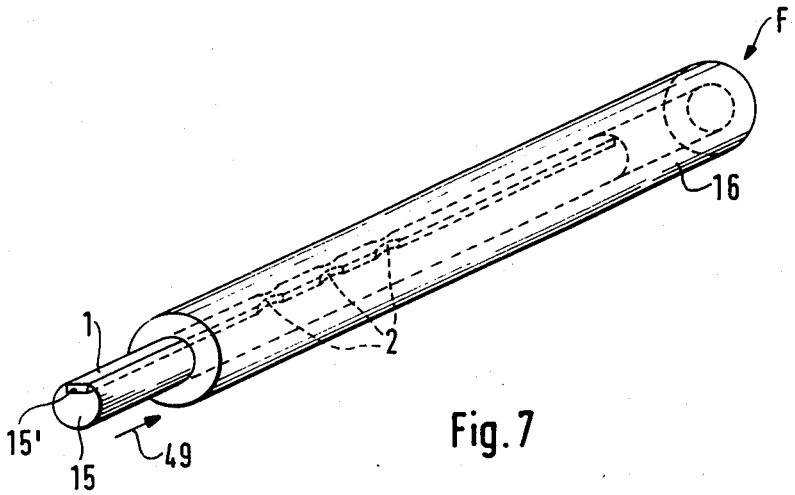
FIG. 7 illustrates a second method of manufacturing the ceramic envelope of the fuse according to the invention.

FIG. 7 illustrates a second method of manufacturing the ceramic envelope 3. A cylindrical rod 15 as well as a tube 16, both made of high density rigid ceramic such as Alumina of formula $Al_2O_3$, and Beryllium oxide of formule BeO, are first produced. The rod 15 is provided with a longitudinal groove 15'. The groove 15' again follows the exact shape of the element 1. After the metallic element 1 has been inserted in the groove 15', the assembly rod 15—element 1 is slid inside the tube 16, as indicated by the arrow 49. A slight difference between the internal diameter of the tube 16 and the external diameter of the rod 15 defines a cylindrical, empty space between these rod and tube, which space is filled with an appropriate inorganic cement suitable for use with ceramic. The resulting assembly is heat treated in a kiln at a temperature lower than the melting point of the fusible element, in order to form a very rigid and impervious cylindrical, ceramic envelope.

Figure 8A:
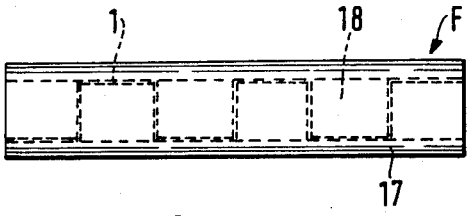
FIGS. 8*a* and 8*b* illustrate a third method of manufacturing the ceramic envelope of the fuse in accordance with the present invention.
Figure 8B:
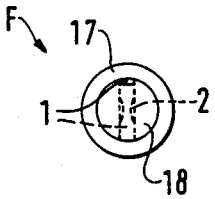

Another method of manufacturing the envelope 3 of the fuse F according to the invention is illustrated in FIGS. 8*a* and 8*b* of the drawings. In this method, a tube 17 as well as a plurality of short cylindrical elements 18 all made of high density rigid ceramic are first produced. Two grooves communicating with each other are formed in each cylindrical element, namely a longitudinal groove formed in the cylindrical surface and a transversal groove formed in one of the two parallel end surfaces of each cylindrical element 18. Again, the grooves of each cylindrical element 18 follow the exact shape of the fusible element 1. An advantage of the ceramic envelope of FIG. 8 is its ability to separate two successive cross section constrictions 2 of the fusible element 1 by means of at least one of the cylindrical elements 18 when such constrictions are positioned in the geometrical axis of the cylindrical envelope as illustrated in FIG. 8*b*. The electric arcs produced in the fuse F upon fusion of these cross section constrictions 2 of the fusible element 1 are therefore separated from each other by at least one of the cylindrical elements 18. These cylindrical elements 18 are inserted end to end in the tube 17 along with the fusible element 1 and joined together and with the tube 17 by means of an appropriate inorganic cement. The so joined elements 18 and tube 17 are again kilned at a temperature lower than the melting point of the fusible element 1 to form a rigid and impervious cylindrical envelope.

Figure 9:
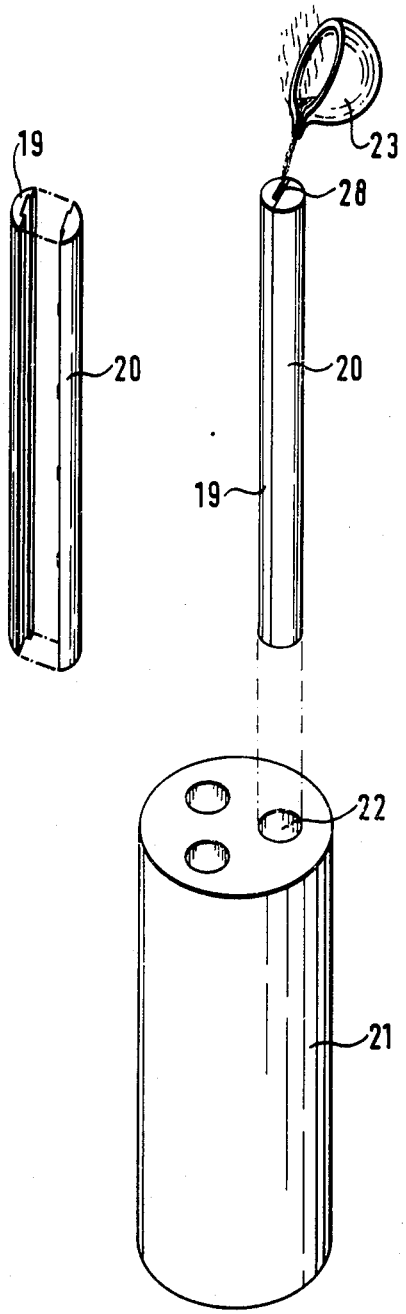
FIGS. 9 and 10 illustrate methods of manufacturing the fuse according to the invention, in which the fusible element is formed through injection of molten metal in a cavity formed in the ceramic envelope.

FIG. 9 illustrates two complementary pieces 19 and 20 which, when assembled together, form a cylindrical rod made of high density rigid ceramic. This rod is then inserted within a cylinder 22 formed within a cylindrical piece 21 also made of high density rigid ceramic.

When assembled( the pieces 19 and 20 define a cavity 28. Molten metal 23 is injected in the cavity 28 to form the fusible element. A centrifugal force can be used to force the molten metal to completely fill the cavity 28, that is with no empty space being formed. In FIG. 9, the fusible element has the shape of a ribbon comprising a plurality of circular perforations.

The pieces 19, 20 and 21 are joined together by means of an inorganic cement, and the so joined pieces are heat treated so as to form a rigid and impervious envelope. The pieces 19 and 20 are joined together by means of the inorganic cement before the molten metal injection. Assembling of the s joined pieces 19 and 20 with the cylindrical piece 21 and any thermal treatment of these pieces can be carried out either before or after the metal injection. If the heat treatment is carried out after the metal injection, it should be remembered that such a treatment should be carried out at a temperature lower than the melting point of the metal forming the fusible element.

The cylindrical piece 21 comprises three cylinders such as 22 to receive three rods such as 19, 20, to thereby form a fuse with three identical fusible elements.

Metals having a high melting point such as tungsten can be used in the manufacture of the high density rigid envelope 3 to form the cavity in which the fusible element 1 is inserted. A ribbon or wire of tungsten having the same shape and dimensions as the fusible element is inserted in the ceramic during its manufacture. When the ceramic has been shaped and fritted under high pressure and high temperature conditions, the ribbon or wire of tungsten is withdrawn and the molten metal is injected in the so formed cavity to constitute the fusible element.

Figure 10:
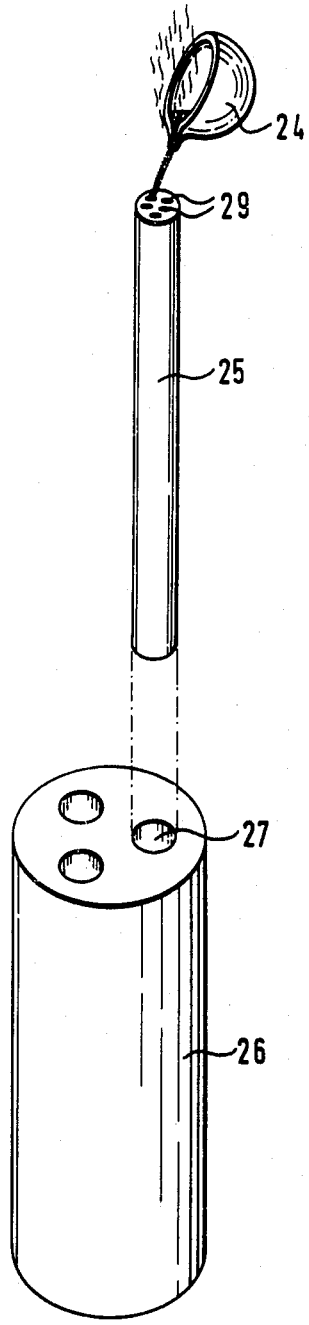

FIG. 10 illustrates the use of a plurality of tungsten wires to form a plurality of parallel filiform cavities of uniform cross section such a 29 within a rod 25 of high density rigid ceramic. After the tungsten wires have been withdrawn, molten metal 24 is injected in each cavity 29 to form a corresponding fusible element. Of course, the diameter of each cavity 29 is selected according to the required characteristics for the operation of the fuse. Again, a centrigual force can be used to prevent any empty space to be formed in the cavity during injection of the molten metal 24. The rod 25 can eventually be inserted in a cylinder 27 formed in a cylindrical piece 26 of high density rigid ceramic, and joined to the same by means of an inorganic cement either before or after the metal injection. Again, the so joined rod 25 and cylindrical piece 26 are heat treated to form a rigid and impervious envelope, before or after the injection of molten metal.

As in the case of FIG. 9, the cylindrical piece 26 is provided with three cylinders such as 27 to receive three rods such as 25 each containing a plurality of fusible elements.

It can be easily appreciated that the fusible element 1 of the embodiments presented in FIGS. 6 and 7 can be manufactured by injection of molten metal.

When the manufacture of the envelope of high density rigid ceramic is completed, which envelope closely surrounds the fusible element(s), the two ends of the envelope are metalized to form two terminals (for example the terminal 5 and 6 of FIG. 1) respectively connected to the two ends of the fusible element(s).

Then, a cylindrical sheath such as 4 (FIG. 1) can be disposed on the ceramic envelope. This sheath is made of ceramic or of fiberglass and its function is to increase the mechanical rigidity of the fuse F.

Although the present invention has been described hereinabove by means of preferred embodiments thereof, such embodiments can be modified at will, within the scope of the appended claims, without changing or altering the nature and scope of the present invention.

What is claimed is:

1. A current-limiting fuse comprising:

a fusible element structured to conduct an electric current and to melt and thereby interrupt said electric current when the same reaches a predetermined value, melting of the fusible element producing an electric arc at a high temperature;

a solid arc-quenching body made of non-porous rigid ceramic closely surrounding the fusible element, said non-porous rigid ceramic having (a) a high dielectric resistivity at the high temperature of the electric arc produced within the solid body upon melting of said fusible element, as well as (b) a high resistance to shocks of high temperature and of internal pressure caused by the production of said electric arc whereby said arc-quenching body resists and is impervious to said internal pressure; and a pair of terminals mounted on said arc-quenching body, interconnected together through the fusible element, and providing for connection of the fusible element in an electric circuit to be protected against an overcurrent.

2. A current-limiting fuse according to claim 1, wherein said non-porous rigid ceramic further has a high thermal conductivity and a high specific heat to rapidly absorb the heat produced within said arc-quenching body by the electric arc.

3. A current-limiting fuse according to claim 1, wherein said ceramic is Alumina of formula $Al_2O_3$.

4. A current-limiting fuse according to claim 1, wherein said ceramic is Beryllium oxide of formula BeO.

5. A current-limiting fuse comprising:

a fusible element structured to conduct an electric current and to melt and thereby interrupt said electric current when the same reaches a predetermined value;

an envelope made of non-porous rigid ceramic closely surrounding the fusible element, said ceramic having a high dielectric resistivity at the high temperature of an electric arc produced within the envelope upon melting of said fusible element, as well as a high resistance to shocks of pressure and high temperature caused by said electric arc;

a pair of terminals mounted on said envelope, interconnected together through the fusible element, and providing for connection of the fusible element in an electric circuit to be protected against an overcurrent; and said fusible element being elongated, and said envelope being formed of two complementary pieces each having a surface of contact with the other of said two pieces, and the contact surface of one of said two complementary pieces being provided with a groove having the same shape and dimensions as the fusible element in order to receive the same.

6. A current-limiting fuse according to claim 5, in which said contact surfaces of the two complementary pieces are joined together with the fusible element inserted in said groove.

7. A current-limiting fuse according to claim 5, wherein said contact surfaces of the two complementary pieces are joined together by means of an inorganic cement, and wherein the so joined two complementary pieces are thereafter subjected to a heat treatment to form a rigid and impervious envelope.

8. A current-limiting fuse comprising:

a fusible element structured to conduct an electric current and to melt and thereby interrupt said electric current when the same reaches a predetermined value;

an envelope made of non porous rigid ceramic closely surrounding the fusible element, said ceramic having a high dielectric resistivity at the high temperature of an electric arc produced within the envelope upon melting of said fusible element, as well as a high resistance to shocks of pressure and high temperature caused by said electric arc;

a pair of terminals mounted on said envelope, interconnected together through the fusible element, and providing for connection of the fusible element in an electric circuit to be protected against an overcurrent; and said fusible element being elongated, and said envelope comprising a tubular portion and a rod, said rod having two ends and comprising a groove interconnecting said two ends, said groove having the same shape and dimensions as the fusible element in order to receive the latter, and said rod being mounted within the tubular portion.

9. A current-limiting fuse according to claim 8, wherein said rod is mounted within the tubular portion with the fusible element inserted in said groove, wherein said rod and tubular portion are joined together by means of an inorganic cement, and wherein the so joined rod and tubular portion are subsequently subjected to a heat treatment to form a rigid and impervious envelope.

10. A current-limiting fuse comprising:

a fusible element structured to conduct an electric current and to melt and thereby interrupt said electric current when the same reaches a predetermined value;

an envelope made of non-porous rigid ceramic closely surrounding the fusible element, said ceramic having a high dielectric resistivity at the high temperature of an electric arc produced within the envelope upon melting of said fusible element, as well as a high resistance to shocks of pressure and high temperature caused by said electric arc;

a pair of terminals mounted on said envelope, interconnected together through the fusible element, and providing for connection of the fusible element in an electric circuit to be protected against an overcurrent; and said fusible element being elongated, said envelope comprising a tubular portion and a plurality of short cylindrical elements, and said cylindrical elements comprising grooves which follow the exact shape of the fusible element and which are so positioned on said cylindrical elements that the fusible element follows a non-linear course when inserted in the grooves of said short cylindrical elements mounted end to end within said tubular portion of the envelope.

11. A current-limiting fuse according to claim 10, wherein said tubular portion and said cylindrical elements are joined together by means of an inorganic cement, the so joined tubular portion and cylindrical elements being subjected to a heat treatment to form a rigid and impervious envelope.

12. A current-limiting fuse according to claim 10, in which said fusible element comprises a plurality of cross section constrictions, and wherein each pair of successive constrictions are separated from each other by at least one of said short cylindrical elements.

13. A current-limiting fuse according to claim 10, wherein each of said short cylindrical elements comprises two planar, end surfaces substantially parallel to each other, and a substantially cylindrical surface interconnecting together said two planar surfaces, and wherein each of said short cylindrical elements comprises a longitudinal groove made in its substantially cylindrical surface and a transversal groove made in one of its two planar surfaces, said longitudinal and transversal grooves communicating with each other.

14. A current-limiting fuse according to claim 1, further comprising a sheath covering the arc-quenching body in order to increase the mechanical rigidity of the said body.

15. A current-limiting fuse according to claim 14, wherein said sheath is made of fiberglass.

16. A current-limiting fuse according to claim 14, wherein said sheath is made of ceramic.

17. A current-limiting fuse according to claim 1, wherein said solid arc-quenching body is metallized at two different locations thereof to form a said pair of terminals.

18. A current-limiting fuse according to claim 1, wherein said arc-quenching body is formed of an inner body made of said non-porous rigid material and closely surrounding at least one fusible element, and of an external envelope having a bore therethrough to receive said inner body.

19. A current-limiting fuse according to claim 1, wherein said arc-quenching body is formed of a plurality of inner bodies made of said non-porous rigid material and each closely surrounding at least one fusible element, and of an external envelope having a plurality of bores therethrough to receive said inner bodies.

20. A current-limiting fuse according to claim 5, wherein said two complementary pieces are elongated, and have a cross section in the form of a half-moon.

21. A current-limiting fuse according to claim 5, wherein said contact surfaces of the two complementary pieces are joined together to define a cavity having the same shape and dimensions as the fusible element, said fusible element being formed by injection of molten metal in said cavity.

22. A current-limiting fuse according to claim 1, wherein said envelope solid arc-quenching body defines a cavity having the same shape and dimensions as the fusible element, said fusible element being formed by injection of molten metal in said cavity.

23. A current-limiting fuse comprising:

a fusible element structured to conduct an electric current and to melt and thereby interrupt said electric current when the same reaches a predetermined value;

an envelope made of non-porous rigid ceramic closely surrounding of the fusible element, said ceramic having a high dielectric resistivity at the high temperature of an electric arc produced within the envelope upon melting of said fusible element, as well as a high resistance to shocks of pressure and high temperature caused by said electric arc;

a pair of terminals mounted on said envelope, interconnected together through the fusible element, and providing for connection of the fusible element in an electric circuit to be protected against an overcurrrent; and said envelope being formed of two complementary pieces each having a surface of contact with the other of said two pieces, and the contact surfaces of said two complementary pieces being formed to define, when assembled together, an inner cavity having the same shape and dimensions as the fusible element, whereby said fusible element can be inserted in said cavity and is closely surrounded by said envelope when inserted within the inner cavity.

* * * * *